United States Patent [19]

Knickerbocker

[11] 4,354,621

[45] Oct. 19, 1982

[54] CHILD RESISTANT ASSEMBLY FOR AEROSOL DISPENSERS

[75] Inventor: Michael G. Knickerbocker, Crystal Lake, Ill.

[73] Assignee: Seaquist Valve Co., Div. of Pittway Corp., Cary, Ill.

[21] Appl. No.: 171,358

[22] Filed: Jul. 23, 1980

[51] Int. Cl.[3] ..... B65D 83/14

[52] U.S. Cl. ..... 222/47; 222/153; 222/402.11; 222/402.13; 222/402.22

[58] Field of Search ..... 222/153, 182, 402.11, 222/403.13, 47, 48, 402.21, 402.22

[56] References Cited

U.S. PATENT DOCUMENTS

| | | | |
|---|---|---|---|
| 2,573,624 | 10/1951 | Svendsen | 222/402.11 X |
| 3,098,589 | 7/1963 | Graham | 222/402.22 |
| 3,138,331 | 6/1964 | Kutik | 222/402.11 X |
| 3,236,421 | 2/1966 | Glazier | 222/402.13 X |
| 3,675,823 | 7/1972 | Steiman | 222/402.22 X |
| 4,024,995 | 5/1977 | Landen et al. | 222/402.11 |
| 4,132,333 | 1/1979 | Debard | 222/402.13 |

*Primary Examiner*—David A. Scherbel
*Attorney, Agent, or Firm*—Frijouf, Rust & Pyle

[57] ABSTRACT

A child resistant assembly is disclosed for use with an aerosol container having a valve. The assembly comprises an actuator button having a terminal orifice connected through a valve stem to the valve for enabling discharge of the aerosol product from the terminal orifice upon opening the valve. An overcap is rotatably secured to the aerosol container and includes a finger actuator movably mounted relative to the overcap. A non-symmetrical aperture is disposed in either the actuator button or the finger actuator for cooperation with a non-symmetrical member in the other of the actuator button and the finger actuator. The non-symmetrical member enters the non-symmetrical aperture for transferring the finger movement of the operator to open the valve only upon a selected orientation of the finger actuator relative to the actuator button.

16 Claims, 36 Drawing Figures

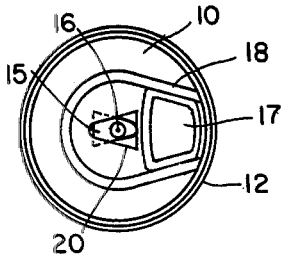
FIG. 5
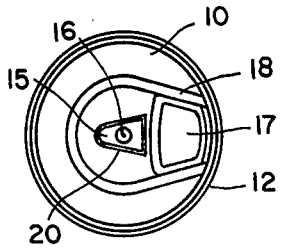
FIG. 7
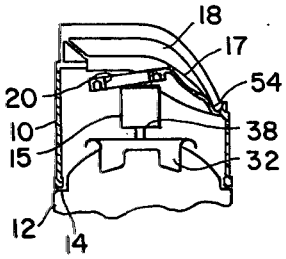
FIG. 6
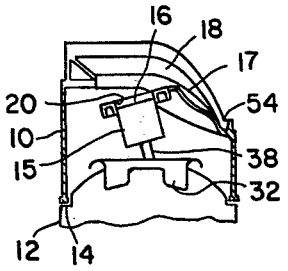
FIG. 8
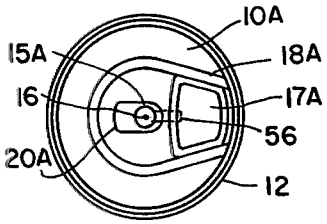
FIG. 9
FIG. 9A
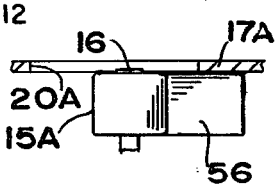
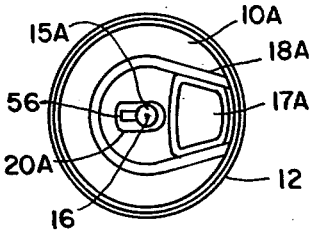
FIG. 10
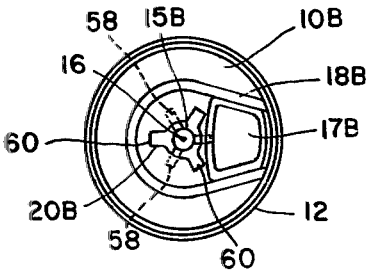
FIG. 11
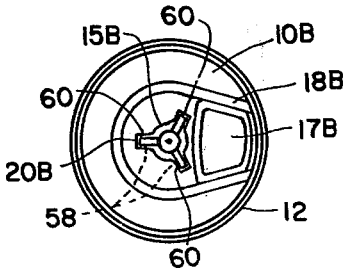
FIG. 12

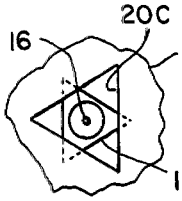
FIG.13
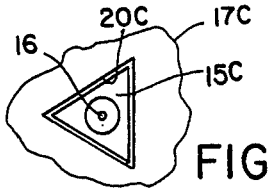
FIG.15
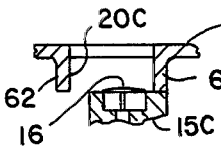
FIG.14
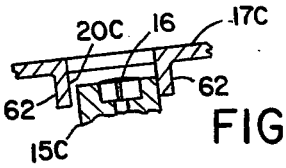
FIG.16
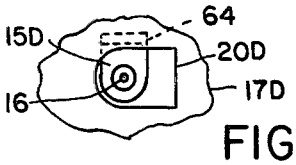
FIG.17
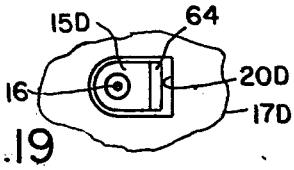
FIG.19
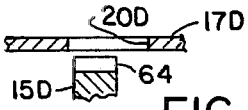
FIG.18
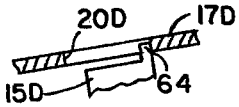
FIG.20
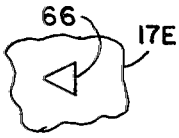
FIG.22
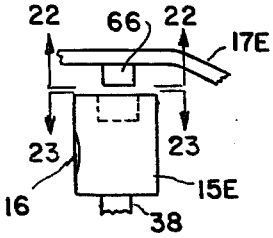
FIG.21
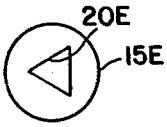
FIG.23
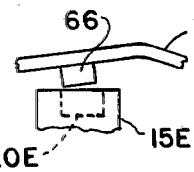
FIG.24
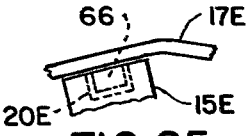
FIG.25
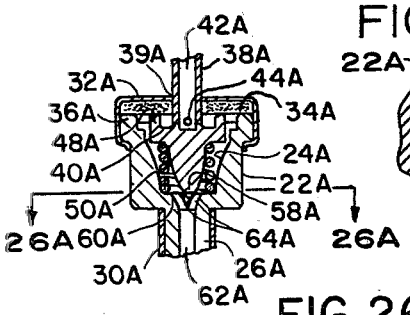
FIG.26
FIG.26A
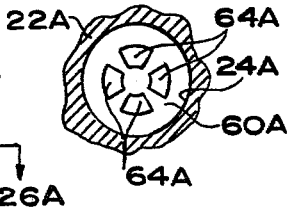
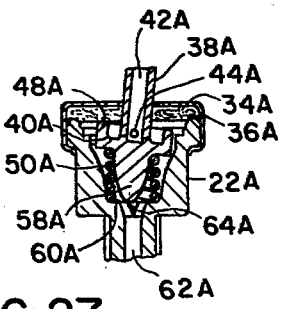
FIG.27

CHILD RESISTANT ASSEMBLY FOR AEROSOL DISPENSERS

BACKGROUND OF THE INVENTION

1. Field of the Invention

This invention relates to aerosol products and containers and more particularly to child resistant assemblies for preventing accidental discharge of the aerosol products by children.

2. Description of the Prior Art

Various types of child resistant containers, bottles, jars and aerosol actuators have been developed in the prior art in an effort to reduce the number of accidental openings and/or discharges of containers by small children. Those skilled in the prior art will appreciate the sophistication and complexity of many of these child resistant containers and/or actuators and the substantial effort expended in the development thereof. It is a prime objective for all of these closures and actuators to provide a simple, efficient and economical child resistant container which may be easily operated by adults or elderly persons while simultaneously being substantially inoperative for a small child.

Many child resistant assemblies have been devised specifically for use with an aerosol product. In a child resistant aerosol assembly, a container is filled with a product and a propellant under pressure to be released upon activation of an aerosol valve. In general, a movement of skill such as aligning component parts or a finger of adult size is required to activate the aerosol valve. The use of additional structural elements to provide the movement of skill or to sense the size of the adult finger adds to the complexity of the aerosol assembly which inhibits the acceptance in the market. The additional parts or components required to make the child resistant aerosol container add to both the material cost and the fabricating cost of the child resistant aerosol assembly.

In general, assembly of the parts for a child resistant aerosol container requires a preferred orientation of the parts during the fabrication process. Accordingly, it is more costly to fabricate a child resistant assembly since the parts must be located in a preferred orientation to properly complete the assembly.

A further requirement of most child resistant aerosol containers is the compatability for use with conventional aerosol containers and conventional aerosol valves. With these severe restrictions and limitations, it can be appreciated by those skilled in the art that a simple and efficient child resistant container has not been developed by the prior art at a reasonable price.

Therefore it is an object of this invention to provide a child resistant assembly which overcomes the inadequacies of the prior art and provides a substantial contribution to the child resistant assemblies for aerosol containers.

Another object of this invention is to provide a child resistant assembly for use with an aerosol container which may be assembled with the same number of component parts as a conventional aerosol assembly.

Another object of this invention is to provide a child resistant assembly for an aerosol container wherein the component parts may be assembled without concern for the orientation of the component parts.

Another object of this invention is to provide a child resistant assembly for an aerosol container utilizing an aerosol overcap having a finger actuator wherein the overcap is rotatably mounted on the container relative to an actuator button for allowing activation of the aerosol valve only upon a selected orientation between the overcap and the actuator button.

Another object of this invention is to provide a child resistant assembly for an aerosol container preferably designed for a tilt valve which discharges aerosol product upon tilting the valve and which inhibits discharge of the aerosol product upon a linear depression of the valve.

Another object of this invention is to provide a child resistant assembly for an aerosol container comprising a non-symmetrical means cooperable with an aperture whereby the valve may be actuated by the operator upon a selected orientation between the non-symmetrical means and the aperture.

Another object of this invention is to provide a child resistant assembly for an aerosol container compatible for use with standard industry aerosol containers and valves.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into a child resistant assembly for use with an aerosol container having a valve for discharging an aerosol product upon moving the valve. The assembly comprises an actuator button having a terminal orifice. A valve stem connects the actuator with the valve for enabling discharge of the aerosol product from the terminal orifice upon opening the valve. An overcap is secured to the aerosol container for at least partially covering the actuator button. A finger actuator is movably mounted relative to the overcap for cooperation with the actuator button. An aperture is disposed on either the actuator button or the finger actuator for cooperation with non-symmetrical means on the other of the actuator button and finger actuator. Means are provided for rotationally mounting the finger actuator relative to the actuator button for enabling the non-symmetrical means to enter the aperture and to transfer the finger movement of the operator to open the valve only upon a selected orientation of the finger actuator relative to the actuator button.

In more specific embodiments of the invention, the finger actuator is pivotably mounted to the overcap with the pivot axis being displaced from the axis of the valve for moving the valve when the non-symmetrical means enters the aperture. The aperture may be a non-symmetrical aperture with the same distinctive shape as the non-symmetrical means enabling the non-symmetrical means to enter in only a limited number of orientations of the finger actuator relative to the actuator button. The finger actuator may be an integral member with the overcap wherein the finger actuator is pivotably mounted relative to the overcap through an integral hinge.

The child resistant assembly is suitable for use with a tilt valve adapted for discharging the aerosol product upon tilting the valve and for inhibiting discharge of the aerosol product upon a vertical depression of the valve. The non-symmetrical means enters the non-symmetrical aperture for transferring the finger movement of the operator to tilt the valve only upon a selected orientation of the finger actuator relative to the actuator button. The non-symmetrical means is prevented from entering the non-symmetrical aperture to transfer the finger movement of the operator to vertically depress the valve upon non-selected orientation of the finger actuator relative to the actuator button. The valve fails to discharge aerosol products if the movement of skill or the selected orientation is not accomplished prior to depression of the finger actuator.

The child resistant assembly is suitable for use with both a vertical and a horizontal aerosol overcap. In the vertical aerosol overcap, the terminal orifice of the actuator button extends at least partially through the non-symmetrical aperture for discharging aerosol product through the non-symmetrical aperture. In the vertical overcap, the non-symmetrical aperture may be disposed in the finger actuator and the non-symmetrical means may comprise the outer configuration of the actuator button. In the horizontal child resistant overcap assembly, the overcap comprises a side wall orifice disposed in a side wall of the overcap with the terminal orifice of the actuator button disposed adjacent to the side wall orifice for discharging aerosol product through the side wall orifice in a direction substantially perpendicular to the axis of the aerosol container. In the horizontal overcap, the non-symmetrical aperture may be disposed on the actuator button with the non-symmetrical means comprising a projection disposed on the finger actuator. It should be understood that the non-symmetrical means and the aperture may be interchanged within the structure in either the vertical or horizontal overcap.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 5 is a plan view of a first embodiment of the child resistant assembly shown in a non-selected orientation;

FIG. 6 is a side sectional view of FIG. 5;

FIG. 7 is a plan view of the first embodiment of FIG. 5 shown in a selected orientation;

FIG. 8 is a side sectional view of FIG. 7;

FIG. 9 is a plan view of a second embodiment of the child resistant assembly shown in a non-selected orientation;

FIG. 9A is an enlarged partial side view of FIG. 9;

FIG. 10 is a plan view of the second embodiment of FIG. 9 shown in the selected orientation;

FIG. 11 is a plan view of a third embodiment of the child resistant assembly shown in the non-selected orientation;

FIG. 12 is a plan view of the third embodiment of FIG. 11 shown in the selected orientation;

FIG. 13 is a plan view of a fourth embodiment of the child resistant assembly shown in a non-selected orientation;

FIG. 14 is a side sectional view of FIG. 13;

FIG. 15 is a plan view of the fourth embodiment shown in a selected orientation;

FIG. 16 is a side sectional view of FIG. 15;

FIG. 17 is a plan view of still a fifth embodiment of the child resistant assembly shown in a non-selected orientation;

FIG. 18 is a side sectional view of FIG. 17;

FIG. 19 is a plan view of the fifth embodiment shown in the selected orientation;

FIG. 20 is a side sectional view of FIG. 19;

FIG. 21 is a side view of a sixth embodiment of the invention;

FIG. 22 is a view along line 22—22 in FIG. 21;

FIG. 23 is a view along line 23—23 in FIG. 21;

FIG. 24 shows the vertical depression of the actuator button of FIG. 21;

FIG. 25 shows the tilting of the actuator button of FIG. 21;

FIG. 26 is an enlarged side sectional view of an alternate valve assembly for use with the present invention;

FIG. 26A is a view along line 26A—26A in FIG. 26;

FIG. 27 shows the valve of FIG. 26 in the tilted position;

Similar reference characters refer to similar parts throughout the several views of the drawings.

DETAILED DESCRIPTION

Figure 1:
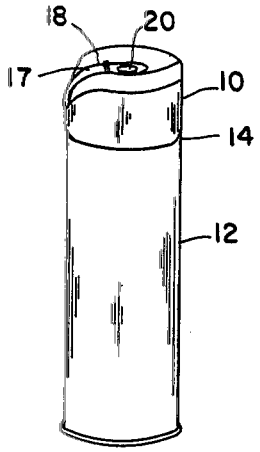
FIG. 1 is a side elevational view of a child resistant assembly incorporated into a vertical spray assembly.
Figure 2:
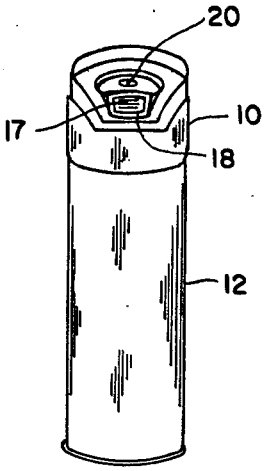
FIG. 2 is a rear elevational view of the container shown in FIG. 1.
Figure 28:
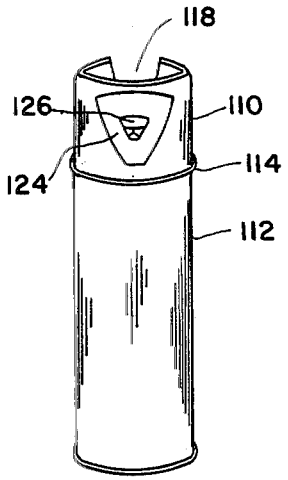
FIG. 28 is an elevational view of a child resistant assembly incorporated into a horizontal overcap.
Figure 29:
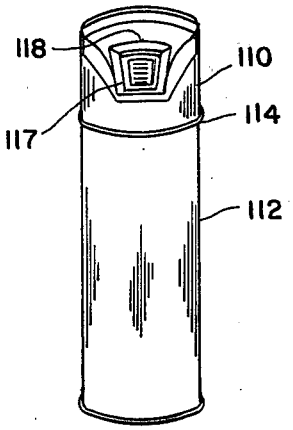
FIG. 29 is a rear elevational view of FIG. 28.

FIG. 1 is a side perspective view of the child resistant overcap 10 disposed on an aerosol container 12 containing a propellant and a product. In this embodiment, the child resistant overcap 10 is affixed to an upper rim 14 of the aerosol container 12. The overcap 10 covers an actuator button 15 having a terminal orifice 16 shown in FIGS. 3 and 4 with a finger actuator 17 disposed adjacent a finger recess 18 in the overcap 10. An aperture 20 is disposed in the finger actuator 17 for enabling a vertical spray to be discharged substantially along the axis of symmetry of the aerosol container 12. It will be appreciated from the following description that the invention may be suitable for use with either a vertical overcap as shown in FIGS. 1 and 2 or a horizontal overcap as shown in FIGS. 28 and 29 or other angular positions therebetween such as a forty five degree angle spray or the like. It should also be understood that the overcap 10 may be secured to other surfaces of the aerosol container 12 including but not limited to the inside or outside rim of the container 12 or the inside or outside rim of the mounting cup or other means.

Figure 3:
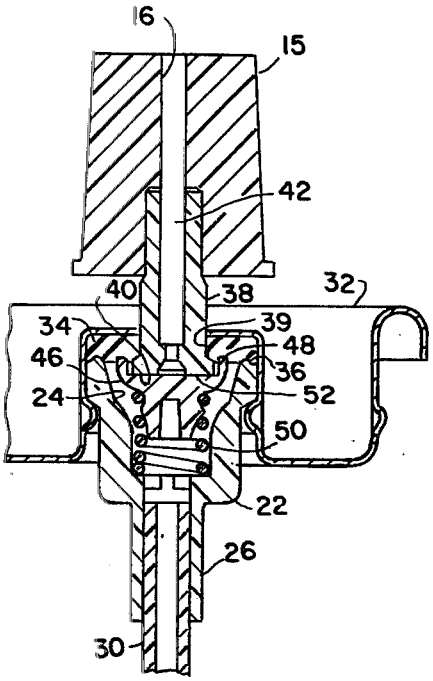
FIG. 3 is an enlarged side sectional view of a valve in the unattended position suitable for use with the overcap assembly shown in FIGS. 1 and 2.
Figure 4:
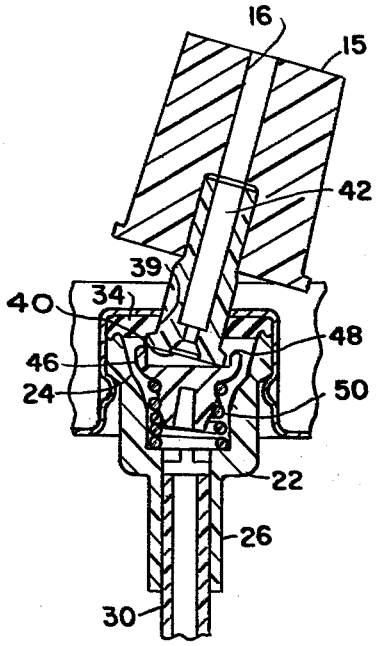
FIG. 4 is a side sectional view similar to FIG. 3 with the valve being shown in the tilted position.

FIGS. 3 and 4 illustrate a valve assembly which is suitable for use with the invention set forth herein. The valve assembly is generally indicated as a tilt valve and includes a valve body 22 having a body cavity 24 formed on the interior thereof. A tail portion 26 is integrally attached or otherwise connected to the valve body 22 and is attached to a dip tube 30. The dip tube 30 is disposed in fluid communication between the interior of the aerosol container 12 and the body cavity 24.

The valve body 22 is mounted to a conventional mounting cup 32 with a sealing gasket 34 disposed in sealing engagement about the upper periphery 36 of the valve body 22. A valve stem 38 having a flat base portion 40, extends through a gasket aperture 39 to allow relatively free movement of the base 40 of the valve stem 38 as will be explained in greater detail hereinafter. The stem 38 has a through aperture 42 extending between the substantially flat base 40 and the actuator button 15. The present invention is compatible with either a one-piece button and valve stem assembly or a distinct actuator button, as shown. A valve stem sealer 46 is disposed within the body cavity 24 with the upper periphery 48 of the valve stem sealer being biased by spring 50 to form a first seal with the sealing gasket 34.

The substantially flat base portion 40 of the valve stem is supported on a substantially flat platform 52 of the valve stem sealer 46. The cooperation of the flat base 40 and the flat platform 52 provides a second seal to prevent propellant and product from issuing from the dip tube 30 to the valve stem 38. The novel valve design shown in FIGS. 3 and 4 will not open to discharge product and propellant upon a vertical depression of the valve stem, but will open only upon a tilt or a toggle action of the valve stem 38. A vertical movement of the valve stem 38 in FIG. 3 disengages the upper periphery 48 of the valve stem sealer 46 from the gasket 34 but a second seal is still maintained between the flat base 40 and the flat platform 52.

FIG. 4 illustrates the tilting of the valve wherein the tilted valve stem 38 enables the upper periphery 48 to disengage from the sealing gasket 34 while the flat base 40 disengages from the flat platform 52. The product and propellant flows from dip tube 30 around the upper periphery 48 of the valve stem sealer 46 and through aperture 42.

FIG. 5 is a plan view of the child resistant assembly with a side sectional view being fully shown in FIG. 6. The finger actuator 17 is pivotally mounted by a pivot 54 to the overcap 10 which overcap is rotatably mounted on the rim 14 relative to the aerosol container 12. In this embodiment, the finger actuator 17 is mounted by a hinge 54 with the pivot axis being displaced from the axis of the valve extending through stem 38 to generate a tilting motion to the valve button 15. Preferably the finger actuator 17 is an integral one-piece member with the overcap 10.

An important aspect of the present invention resides in an aperture disposed in either the actuator button or the finger actuator for cooperation with a non-symmetrical means in the other of the actuator button or the finger actuator. In FIGS. 5–8, the aperture 20 is disposed in the finger actuator 17 and the non-symmetrical means comprises the actuator button 15. In this specification, the term "non-symmetrical means" refers to a non-symmetry about an axis extending through the valve stem 38. In the embodiment shown in FIGS. 5–8, the actuator button 15 has the shape of an arrowhead with the aperture 20 also being a non-symmetrical aperture having an identical shape but being slightly larger than the outer configuration of the actuator button 15. The distinctively shaped non-symmetrical aperture 20 is slightly larger than the distinctively shaped non-symmetrical means of the actuator button 15 enabling the actuator button 15 to enter the aperture 20 at a skewed angle in only a limited number of selected orientations.

FIG. 5 illustrates a non-selected orientation between the button 15 and the overcap 10 wherein the aperture 20 will not receive the non-symmetrical actuator button 15.

FIG. 6 illustrates the result of depressing the finger actuator 17 when the actuator button 15 and the finger actuator 17 are in the non-selected orientation as shown in FIG. 5. The finger actuator 17 immediately contacts the upper surface of the non-symmetrical button 15 to vertically depress the valve stem 38. As previously explained, there is no discharge of product and propellant from the aerosol container 12. Accordingly, this assembly reduces the risk of accidental discharge of product and propellant from the container by a child.

FIG. 7 illustrates a plan view of the child resistant assembly shown in FIGS. 5 and 6 in the selected orientation of the finger actuator 17 relative to the actuator button 15. It is evident that the overcap 10 has been rotated 180 degrees relative to the container 12 to align the non-symmetrical actuator button 15 and the non-symmetrical aperture 20.

FIG. 8 illustrates the result of depressing of the finger actuator 17 with the selected orientation as shown in FIG. 7. The non-symmetrical button 15 at least partially enters the non-symmetrical aperture 20 whereby a side wall of the aperture engages the button 15 to tilt the valve stem 38 and discharge product and propellant from the terminal orifice 16 and through the aperture 20.

It should be clear that the invention resides in a unique tilt valve in combination with a non-symmetrical means and an aperture being disposed on either the finger actuator or the actuator button. This combination enables discharge of product and propellant from the container only upon a selected or desired orientation therebetween. Once the first embodiment of this invention is made apparent, it is clear that numerous other embodiments can be readily constructed in accordance with the basic teaching of the embodiment shown in FIGS. 1-8.

FIGS. 9, 9A and 10 show a second embodiment of a child resistant assembly in a non-selected and a selected orientation, respectively. In this embodiment, the aperture 20A is an oval with the non-symmetrical means being a projection 56 extending from the actuator button 15A substantially perpendicular to the axis of the valve stem 38. FIGS. 9 and 9A show the non-selected orientation wherein the projection 56 strikes the underside of the finger actuator 17A upon depression thereof as shown in FIG. 9A. In the selected orientation shown in FIG. 10, the actuator button 15A including the projection 56 is received within the non-symmetrical aperture 20A to enable the side of aperture 20A to engage a side of the actuator button 15A to tilt the valve in a manner similar to that shown in FIG. 8. The embodiment in FIGS. 5-8 has a single selected orientation between the actuator button and the finger actuator. In an alternative embodiment, the projection 56 may cooperate with a second projection extending downwardly from the underside of the finger actuator 17A in the selected orientation.

FIGS. 11 and 12 show of a third embodiment of the child resistant assembly in a non-selected and selected orientation, respectively. The actuator button 15B has at least one projection for cooperation with a groove. In this example, a plurality of projections 58 extend substantially perpendicular to the axis of the valve stem 38. The non-symmetrical aperture 20B includes three radially spaced grooves 60 for receiving the projections upon the selected orientation. The interrelation between the actuator button and finger actuator is identical to that heretofore described except that three selected angular orientations exist between the overcap 10B and the actuator button 15B. It should be understood that a non-equiangular relationship may exist between the projection 58 producing a single selected angular orientation.

FIG. 13 illustrates a fourth embodiment of the invention wherein a finger actuator 17C has a substantially triangular shaped non-symmetrical aperture 20C disposed above a substantially triangular shaped actuator button 15C. FIG. 14 is a side sectional view of FIG. 13 showing aperture 20C comprising side walls 62 extending downwardly from the finger actuator 17C. The substantially triangularly shaped actuator button 15C may be an isosceles or an equilateral triangle. Other variations such as stars, crosses and the like may be utilized in the practice of this invention.

FIGS. 15 and 16 show plan and side sectional views of the assemblies shown in FIGS. 13 and 14 in the selected orientation. In FIG. 15, the triangular shaped button 15C is oriented relative to aperture 20C such that the button 15C is partially received in aperture 20C as shown in FIG. 16. It can be appreciated that actuator button 15C is not received completely through the aperture 20C but is activated by the side walls 62.

FIGS. 17-20 represent a fifth embodiment of the invention with a non-selected orientation being shown in FIGS. 17 and 18 and a selected orientation being shown in FIGS. 19 and 20. The non-symmetrical aperture 20D is substantially D-shaped with the actuator button 15D having a top projection 64 extending upwardly from the actuator button 15D. In the non-selected position as shown in FIGS. 17 and 18, the projection 64 contacts the bottom surface of the finger actuator 17D to vertically depress the valve button 15D. In the selected orientation, as represented by FIGS. 19 and 20, top projection 64 is engaged by the side wall of aperture 20D to tilt the valve stem as heretofore described. This embodiment illustrates the non-symmetrical means as being a projection extending upwardly from the valve button.

A sixth embodiment of the invention is illustrated in FIGS. 21-25. In this embodiment, the aperture 20E is disposed in the valve button 15E whereas the non-symmetrical means is a projection 66 extending downwardly from the finger actuator 17E. The non-symmetrical means 66 is shown more fully in FIG. 22 whereas the aperture 20E is shown more fully in FIG. 23.

In the non-selected orientation as shown in FIG. 23, movement of the finger actuator 17E causes a vertical depression of the actuator button 15E. In the selected position, as illustrated in FIG. 25, a depression of the finger actuator 17E results in a tilting of the actuator button 15E to dispense aerosol product. FIGS. 21-25 shows the utilization of an aperture within the actuator button cooperating with non-symmetrical means in the finger actuator. It should be understood that the concept may be utilized in either the vertical or horizontal overcap.

FIGS. 26 and 27 illustrate a modification of the valve assembly shown in FIGS. 3 and 4 which is suitable for use with the invention set forth herein. The valve assembly is a tilt valve having a valve body 22A with a body cavity 24A formed on the interior thereof. The tail portion 26A is integrally attached to the valve body and is attached to a dip tube 30A. The valve body 22A is mounted on a conventional turret 32A with a sealing gasket 34A disposed in sealing engagement about the upper periphery 36A of the valve body 22A. The valve stem 38A extends through a gasket aperture 39A to allow relatively free movement of the valve stem 38A The stem 38A has a through aperture 42A and a wall aperture 44A extending in proximity to a valve stem sealer 40A. An upper periphery 48A of the valve stem sealer 40A is biased by a spring 50A to form a first seal with gasket 34A. A tail piece 58A of the stem sealer 40A is rounded to ride on a substantially flat base 60A of the valve body. An aperture 62A of the tail piece 26A has plural orifices 64A shown as four orifices in FIG. 26A. The substantially flat base 60A prevents vertical movement of the valve stem 38A. It should be understood that various other means may be utilized for inhibiting vertical movement of the valve stem 28A and these other means should be considered equivalent to the disclosed embodiment.

FIG. 27 illustrates the tilting of the valve whereby the tail piece 58 is displaced horizontally on the base 60A to disengage upper periphery 48A from the gasket 34 enabling product to flow from the container through at least one of the plural orifices 64A. The plural orifices 64A shown in FIG. 26A enables flow of product and propellant therethrough irrespective of the direction of tilt of valve stem 38A.

FIGS. 28-34 show various views of a horizontal embodiment of the present invention. The horizontal child resistant assembly comprises an overcap 110 affixed to the upper rim 114 of an aerosol container 112. The overcap 110 covers an actuator button 115 having a terminal orifice 116 more clearly shown in FIGS. 30 and 33. A finger actuator 117 is located in a finger recess 118 of the overcap 112. An aperture 120 is disposed in the finger aperture 117 for receiving a non-symmetrical means, shown as a projection 122, extending from the top of actuator button 115. The overcap comprises a front recess 124 having a recess orifice 126 located adjacent the terminal orifice 116 of the actuator button enabling a horizontal spray to be discharged substantially perpendicular to the axis of the aerosol container 112.

Figure 30:
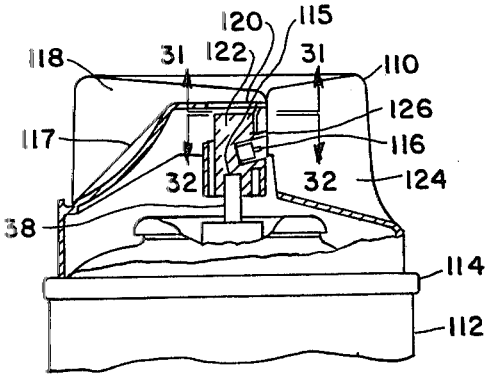
FIG. 30 is a side view partially in section of the horizontal overcap assembly shown in FIGS. 29 and 30.
Figure 31:
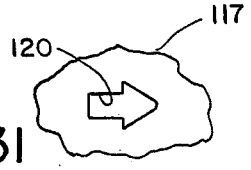
FIG. 31 is a view along line 31—31 in FIG. 30.
Figure 32:
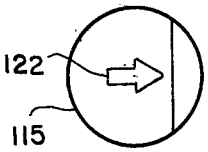
FIG. 32 is a view along line 32—32 in FIG. 30.

FIG. 30 is a side view partially in section of the container shown in FIGS. 28 and 29 with more specific details of the aperture 120 and the projection 122 shown more clearly in FIGS. 31 and 32. In this embodiment, the non-symmetrical aperture and the non-symmetrical means takes the shape of an arrow resulting in a single selected orientation therebetween.

Figure 33:
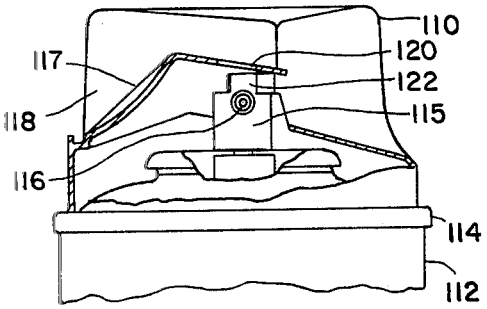
FIG. 33 is a side view partially in section showing a vertical depression of the valve assembly of FIGS. 28–32 in the non-selected orientation.
Figure 34:
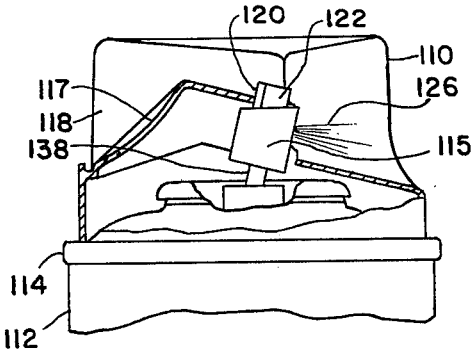
FIG. 34 is a side view partially in section showing; the activation of the child resistant assembly of FIGS. 28–30.

FIG. 33 illustrates the depression of the finger actuator 117 when the actuator button is in a non-selected orientation. Movement of the finger actuator 117 causes a vertical depression of the actuator button 115 resulting in no discharge of product and propellant. FIG. 34 demonstrates the tilting of the valve stem 138 and the actuator button 115 upon depression of the finger actuator 117 when the valve button 115 is in the selected orientation relative to the overcap 110. The projection 122 is received in aperture 120 enabling the force of actuator 117 to tilt the valve button 115. It should be appreciated that the horizontal configuration results in a double safety feature for this child resistant container. The first child resistant feature resides in the fact that a non-selected orientation between the actuator button 115 and the finger actuator 117 will cause a vertical depression of the valve button to inhibit flow of product and propellant due to the novel tilt valve assembly. The second safety feature embodied in the horizontal version is that the terminal orifice 116 is rotated away from the recess orifice 126 in the non-selected orientation. Accordingly, even in the remote possibility of a malfunction of the tilt valve in the non-selected orientation, any direct spray will be contained within the horizontal overcap 110.

The foregoing has set forth a novel child resistant assembly which is adaptable to either a horizontal or a vertical overcap. The novel configuration resides in part in the simplicity of operation and the simplicity of the parts required to fabricate the assembly. The embodiments shown herein do not require any additional component parts from a conventional aerosol overcap assembly. Furthermore, the invention does not require any orientation of the valve button relative to the overcap assembly. Since the insertion of the valve button and the overcap assembly is generally accomplished at separate places during assembly, the lack of required orientation is extremely desirable to the aerosol industry.

The present disclosure includes that contained in the appended claims as well as that of the foregoing description. Although this invention has been described in its preferred form with a certain degree of particularly, it is understood that the present disclosure of the preferred form has been made only by way of example and that numerous changes in the details of construction and the combination and arrangement of parts may be resorted to without departing from the spirit and scope of the invention.

Now that the invention has been described, I claim:

1. A child resistant assembly for use with an aerosol container having a tilt valve for discharging an aerosol product upon tilting the valve, comprising in combination:

an actuator button having a terminal orifice;

a valve stem connecting said actuator button with the tilt valve for enabling discharge of the aerosol product from said terminal orifice upon tilting the valve;

an overcap secured to the aerosol container for at least partially covering said actuator button;

a finger actuator movably mounted relative to said overcap;

an aperture disposed in one of said actuator button and said finger actuator for cooperation with non-symmetrical means on the other of said actuator button and said finger actuator; and means for rotationally mounting said finger actuator relative to said actuator button for enabling said non-symmetrical means to enter said aperture and to transfer the finger movement of the operator to tilt the valve only upon selected orientation of said finger actuator relative to said actuator button.

2. A child resistant assembly as set forth in claim 1, wherein said finger actuator is pivotally mounted to said overcap with said pivot axis being displaced from the axis of the valve for generating a tilting motion to the valve when said non-symmetrical means enters said aperture.

3. A child resistant assembly as set forth in claim 1, wherein said aperture is a non-symmetrical aperture with the same distinctive shape as said non-symmetrical means enabling said non-symmetrical means to enter said non-symmetrical aperture in only a limited number of selected orientations of said finger actuator relative to said actuator button.

4. A child resistant assembly as set forth in claim 3, wherein said non-symmetrical aperture is larger than said non-symmetrical means enabling said non-symmetrical means to enter said non-symmetrical aperture at a skewed angle.

5. A child resistant assembly as set forth in claim 1, wherein said finger actuator is an integral member with said overcap; and said finger actuator being pivotably mounted relative to said overcap through an integral hinge.

6. A child resistant assembly as set forth in claim 1, wherein said terminal orifice of said actuator button extends at least partially through said aperture for discharging the aerosol product through said aperture.

7. A child resistant assembly as set forth in claim 1, wherein said aperture is disposed in said finger actuator; and said non-symmetrical means comprising an outer configuration of said actuator button.

8. A child resistant assembly as set forth in claim 7, wherein said non-symmetrical means comprises the outer circumferential surface of said actuator button.

9. A child resistant assembly as set forth in claim 7, wherein said orifice is defined by a substantially continuous projection extending from said finger actuator for defining said aperture therein.

10. A child resistant assembly as set forth in claim 7, wherein said non-symmetrical means comprises a projection extending from said actuator button.

11. A child resistant assembly as set forth in claim 1, wherein said aperture is disposed in said actuator button; and said non-symmetrical means extends from said finger actuator.

12. A child resistant assembly for use with an aerosol container having a tilt valve for discharging aerosol product upon tilting the valve and for inhibiting discharge of the aerosol product upon a vertical depression of the valve, the improvement comprising in combination:

an actuator button having a terminal orifice;

a valve stem connecting said actuator button with the valve for discharging the aerosol product through said terminal orifice upon tilting the valve;

an overcap rotatably secured to said aerosol container for at least partially covering said actuator button;

a finger actuator pivotably mounted to said overcap with the axis of said pivot being displaced from the axis of the valve;

a non-symmetrical aperture disposed in one of said actuator button and said finger actuator for cooperation with non-symmetrical means in the other of said actuator button and said finger actuator;

said non-symmetrical means entering said non-symmetrical aperture to transfer the finger movement of the operator to tilt the valve only upon selected orientation of said finger actuator relative to said actuator button; and said non-symmetrical means being prevented from entering said non-symmetrical aperture for transferring the finger movement of the operator to vertically depress the valve upon non-selected orientation of said finger actuator relative to said actuator button.

13. A child resistant assembly as set forth in claim 12, wherein said finger actuator engages an upper surface of said non-symmetrical means to vertically depress the valve upon non selected orientation of said finger actuator relative to said actuator button; and said non-symmetrical means at least partially entering said non-symmetrical aperture enabling said non-symmetrical means to engage a sidewall of said non-symmetrical aperture to tilt said valve upon selected orientation of said finger actuator relative to said actuator button.

14. A child resistant assembly as set forth in claim 12, wherein said non-symmetrical means engages a region adjacent said non-symmetrical aperture to vertically depress said valve upon non-selected orientation of said finger actuator relative to said actuator button; and said non-symmetrical means at least partially entering said non-symmetrical aperture to engage a sidewall of said non-symmetrical aperture to tilt said valve upon selected orientation of said finger actuator relative to said actuator button.

15. A child resistant assembly as set forth in claim 12, wherein said terminal orifice of said actuator button at least partially extends through said non-symmetrical aperture for discharging the aerosol product through said non-symmetrical aperture in a direction substantially along the axis of the aerosol container.

16. A child resistant assembly as set forth in claim 12, wherein said overcap comprises an orifice disposed in a side wall of said overcap with said terminal orifice of said actuator button disposed adjacent said side wall orifice for discharging the aerosol product through said side wall orifice in a direction substantially perpendicular to the axis of the aerosol container.

* * * * *